US007559720B2

(12) United States Patent
Neden et al.

(10) Patent No.: US 7,559,720 B2
(45) Date of Patent: Jul. 14, 2009

(54) CULVERT BUNDLE FOR STREAM CROSSINGS AND FLOW-THROUGH BRIDGE ABUTMENTS

(75) Inventors: Ronald J. Neden, Armstrong (CA); Calvin D. VanBuskirk, Salmon Arm (CA)

(73) Assignee: Terratech Consulting Ltd., Salmon Arm, BC (CA)

( * ) Notice: Subject to any disclaimer, the term of this patent is extended or adjusted under 35 U.S.C. 154(b) by 0 days.

(21) Appl. No.: 11/741,642

(22) Filed: Apr. 27, 2007

(65) Prior Publication Data

US 2007/0253775 A1 Nov. 1, 2007

Related U.S. Application Data

(60) Provisional application No. 60/746,125, filed on May 1, 2006.

(51) Int. Cl.
*E01F 5/00* (2006.01)
*F16L 9/18* (2006.01)

(52) U.S. Cl. ..... 405/124; 405/43; 138/112; 404/2

(58) Field of Classification Search ..... 405/126, 405/43, 45, 124; 138/111, 112
See application file for complete search history.

(56) References Cited

U.S. PATENT DOCUMENTS

| | | | | |
|---|---|---|---|---|
| 1,718,978 | A * | 7/1929 | Protzeller | 138/112 |
| 1,799,673 | A * | 4/1931 | Burke et al. | 138/112 |
| 1,801,451 | A * | 4/1931 | Parker | 138/112 |
| 2,039,387 | A * | 5/1936 | Burke et al. | 138/112 |
| 4,199,009 | A * | 4/1980 | Ballone | 138/112 |
| 4,741,593 | A * | 5/1988 | Fochler | 385/134 |
| 4,824,288 | A * | 4/1989 | Naito | 405/48 |
| 4,995,759 | A * | 2/1991 | Plowman et al. | 405/43 |
| 5,516,229 | A * | 5/1996 | Atchley et al. | 405/36 |
| 6,702,517 | B2 | 3/2004 | Goddard | |

* cited by examiner

*Primary Examiner*—Tara Mayo-Pinnock

(57) ABSTRACT

A culvert bundle and fill assembly for stream crossings and flow-through bridge abutments comprising: (a) a first separator fabric; (b) a plurality of culverts placed on the fabric adjacent to one another along their lengths; (c) a plurality of triangular cross-section blocks placed in pairs in upper and lower spaces between adjacent culverts; (d) a plurality of fasteners placed around the plurality of culverts and blocks for holding the culverts and blocking in position; (e) a second separator fabric placed over the plurality of culverts and blocks; and (f) soil or other fill placed over the second separator fabric and the plurality of culverts and blocking to create a road or other crossing structure surface.

5 Claims, 2 Drawing Sheets

CULVERT BUNDLE FOR STREAM CROSSINGS AND FLOW-THROUGH BRIDGE ABUTMENTS

REFERENCE TO RELATED APPLICATION

This application claims the benefit of the filing date of U.S. provisional application Ser. No. 60/746,125, filed 1 May 2006.

TECHNICAL FIELD

This invention relates to road construction and, more particularly, culvert bundles that are used in the construction of roads and other structures across streams and rivers.

BACKGROUND

U.S. Pat. No. 6,702,517 (Goddard, 2004) discloses multiple culverts. Smaller pipes are positioned between larger pipes. This arrangement results in stress concentrations at the small areas of contact. Under higher loads, these stress concentrations would lead to significant bending and ultimately rupture of the larger diameter pipes.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

An arrangement of culverts, blocking, fasteners and fabric to allow the construction and/or removal of stream crossings with very little disturbance of the stream and negligible deposition of sediment into the stream. A similar arrangement to allow the construction of load-bearing abutments for bridges while increasing the flow capacity of the crossing without increasing the height or clear span required for the bridge. If flexible culverts are used, they can be installed on uneven ground with very little site preparation and hence little disturbance of the stream and adjacent riparian area.

The invention is directed to a culvert bundle and fill assembly for stream crossings and flow-through bridge abutments comprising: (a) a first separator fabric placed over a streambed; (b) a plurality of culverts placed on the separator fabric and blocked into position; (c) a plurality of bands, cables or strapping fasteners holding the culverts and blocks in position; (d) a second separator fabric placed over the plurality of culverts; and (e) fill placed over the second separator fabric and the plurality of culverts to create a road surface.

The invention is also directed to a culvert bundle and fill assembly for flow-through bridge abutments comprising: (a) a separator fabric placed over the abutment area; (b) a plurality of culverts placed on the fabric and blocked into position; (c) a plurality of bands, cables, strapping or other fasteners holding the culverts and blocks in position; (d) wrapping the end of the fabric over the plurality of culverts; (e) fill placed over and adjacent to the fabric and culvert bundle; and (f) placement of the bridge foundation over the culvert bundle.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The invention consists of a series of culverts laterally supported by blocks formed to the shape of the culverts and all fastened to each other. The bundle of culverts is covered by fill, up to the level of the road or crossing elevation. Without the blocking, the culverts would need to be more widely spaced to provide lateral support by compacted soil. With blocking, a greater stream discharge capacity is provided for a given crossing width and elevation of crossing surface above the streambed.

For temporary installations, a separator fabric such as a geotextile fabric is placed on the streambed prior to placing the culvert bundle to further reduce potential impacts on the streambed and adjacent area. To minimize sediment deposition to the stream during construction and/or removal of the culvert assembly, another separator fabric such as a geotextile fabric layer is placed over the culvert bundle to contain the backfill soil. To avoid spilling of fill into the stream at the ends of the culvert bundles, end walls known to those skilled in the art would be constructed.

Figure 1:
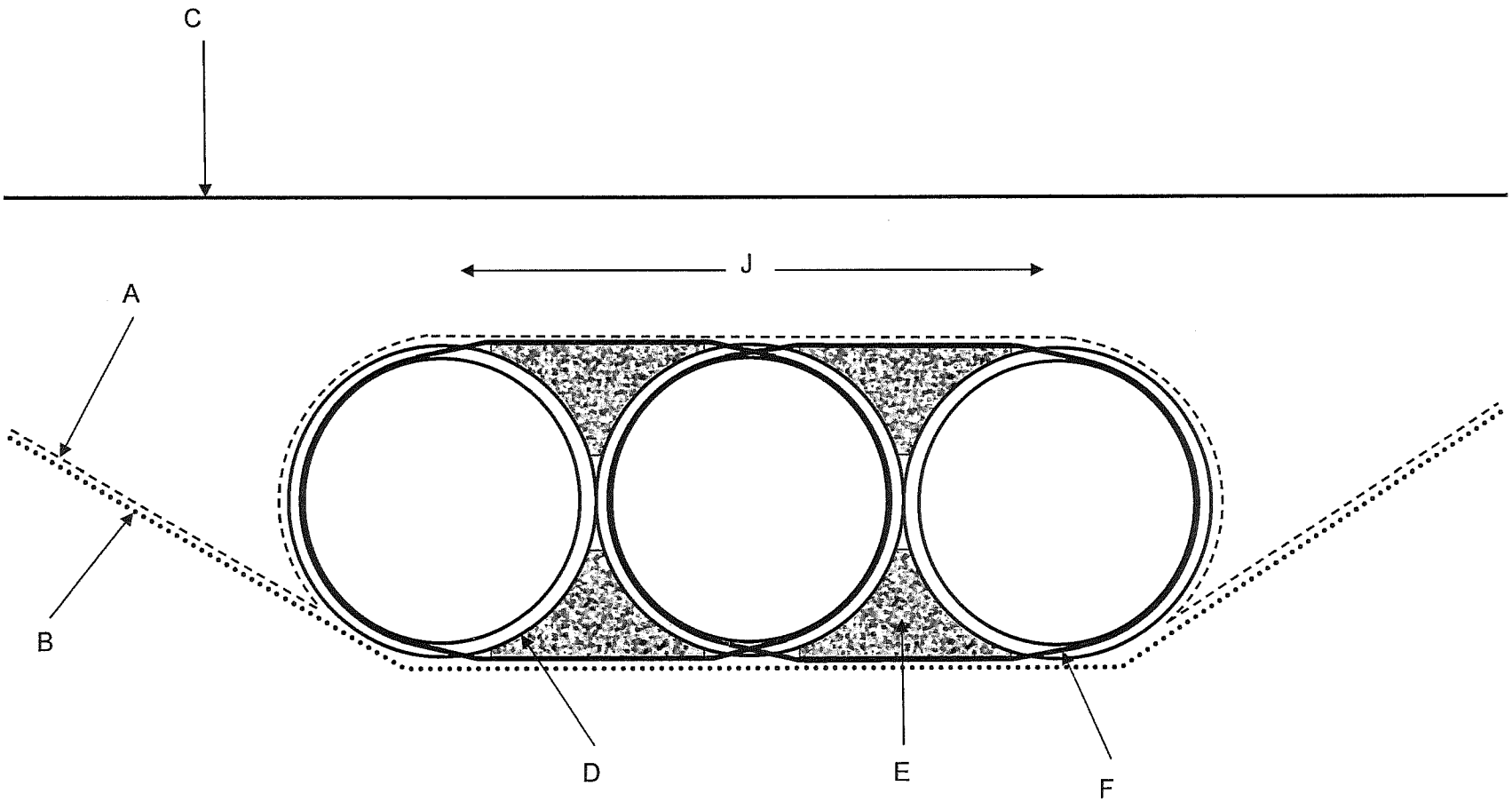
FIG. 1 is a vertical cross section, across the stream, approximately perpendicular to the stream centerline.

Referring to the drawings, FIG. 1 illustrates a vertical cross-section view of culverts located on a separator fabric B on a streambed, wrapped in a second separator fabric A and tied together with bands, cables or strapping fasteners F. Fill J is placed over and adjacent to the bundle to create a road or crossing structure surface C. The culvert bundle according to the invention uses shaped blocking E between the culverts D to provide a large contact area and hence provide lower and more uniform pressure on the culverts D. Thus these culvert bundles will withstand heavy industrial traffic and bridge abutment loads.

The culverts (D) can be constructed of corrugated or non-corrugated materials. The culvert material can be metal (commonly steel or aluminium), concrete, plastic or other suitable materials. The blocking material (E) can be plastic, concrete, rubber, metal and in suitable situations wood. Backfill material (J) can be compacted soil, rockfill and in suitable situations wood and/or ice and snow.

The fastener (F) illustrated on FIG. 1 can be banding, strapping or cable of metal, plastic, or other suitable material.

Other fasteners (not shown) also could be used, such as glues, screws, nuts and bolts, threaded rods, etc.

The separator fabrics A and B can be geotextile or like sheet materials that prevent fill from entering the culvert bundle or stream.

Figure 2:
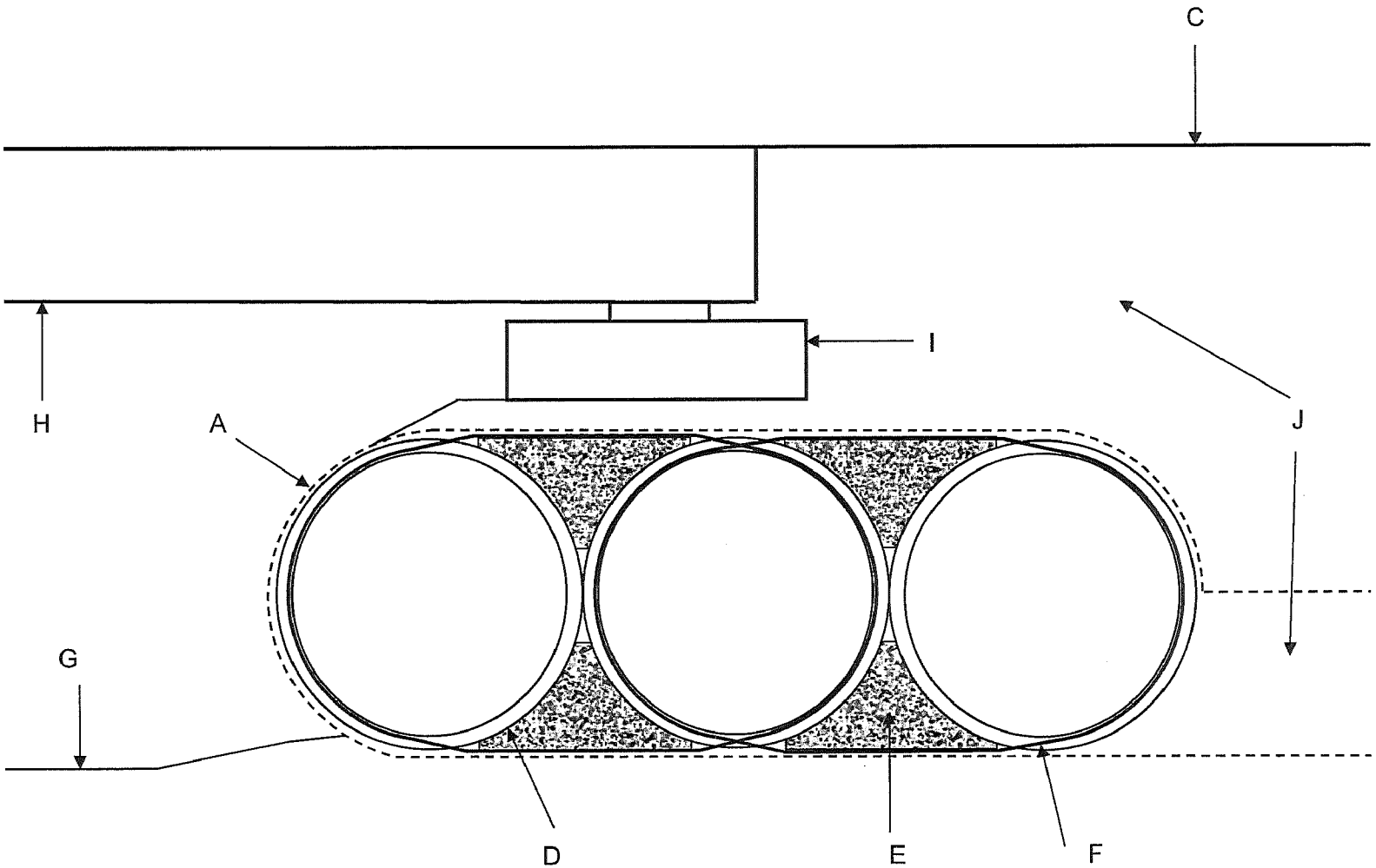
FIG. 2 is a vertical cross section at a bridge abutment, parallel to the road or crossing structure centerline.

FIG. 2 illustrates a vertical cross-section view of a culvert bundle located at a bridge abutment I, including separator fabric A around the culvert bundle and bands, cables or strapping fasteners F holding the culverts D and blocking E in position.

The bridge foundations I are placed on a thin layer of compacted soil or other suitable material above the culvert assembly D. If the bridge H needs to be placed at a higher elevation, additional culvert bundles can be placed on top of one another. If greater stream discharge capacity is required, the culvert bundle can be extended laterally by fastening additional culverts D and blocking E and fasteners F. Backfill material J is placed over and adjacent to the culvert bundle.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A culvert and soil assembly for stream crossings and flow-through bridge abutments comprising:

(a) a first separator fabric;

(b) at least a first, a second and a third cylindrical culvert placed in parallel on the fabric adjacent to one another along their lengths;

(c) a first pair of triangular cross-section blocks placed in upper and lower spaces between the first and the second culverts;

(d) a second pair of triangular cross-section blocks placed in upper and lower spaces between the second and the third culverts;

(e) a first fastener placed around the first and second culverts and the first pair of blocks for holding the first and second culverts and the first pair of blocks in position;

(f) a second fastener placed around the second and third culverts and the second pair of blocks for holding the second and third culverts and the second pair of blocks in position;

(g) a second separator fabric placed over the first, second and third culverts and the first and second pair of blocks; and (h) soil or other fill placed over the second fabric, the culverts, the blocks and the first separator fabric to create a road or crossing structure surface.

2. An assembly as claimed in claim 1 wherein the first separator fabric, the culverts, blocks and fasteners and the second separator fabric are located under a bridge footing forming part of a bridge abutment.

3. An assembly as claimed in claim 1 wherein the culvert abutting sides of the triangular cross-section blocks have inward curvatures which conform with the outer curvature of the abutting culverts.

4. An assembly as claimed in claim 3 wherein a bridge foundation is placed over the second fabric, culverts and blocks.

5. A method of constructing a culvert and soil assembly for stream crossings and flow-through bridge abutments comprising:

(a) placing over a streambed a first separator fabric;

(b) placing at least a first, a second and a third culvert in parallel on the fabric adjacent to one another along their lengths;

(c) placing a first pair of triangular cross-section blocks in upper and lower spaces between the first and second culverts;

(d) placing a second pair of triangular cross-section blocks in upper and lower spaces between the second and third culverts;

(e) placing a first fastener around the first and second culverts and the first pair of blocks for holding the first and second culverts and the first pair of blocks in position;

(f) placing a second fastener around the second and third culverts and the second pair of blocks for holding the second and third culverts and the second pair of blocks in position;

(g) placing a second separator fabric over the plurality of culverts and blocks; and (h) placing soil or other fill over the second fabric and the plurality of culverts and blocks to create a road or crossing surface structure.

* * * * *